US006633271B1

(12) United States Patent
Motegi et al.

(10) Patent No.: US 6,633,271 B1
(45) Date of Patent: Oct. 14, 2003

(54) INTEGRATED CIRCUIT FOR DRIVING LIQUID CRYSTAL

(75) Inventors: Shuji Motegi, Ashikaga (JP); Hiroyuki Arai, Gunma (JP); Tetsuya Tokunaga, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/455,856

(22) Filed: Dec. 7, 1999

(30) Foreign Application Priority Data

Dec. 10, 1998 (JP) ..... 10-351782
Dec. 15, 1998 (JP) ..... 10-356445

(51) Int. Cl.[7] ..... G09G 3/36
(52) U.S. Cl. ..... 345/87; 345/95
(58) Field of Search ..... 345/100, 211, 345/215, 89, 98, 99, 205, 204, 216, 212, 169, 87; 340/781

(56) References Cited

U.S. PATENT DOCUMENTS

| | | | | | |
|---|---|---|---|---|---|
| 4,403,777 | A | | 9/1983 | Del Principe et al. | 273/313 |
| 5,159,326 | A | | 10/1992 | Yamazaki et al. | 340/284 |
| 5,250,937 | A | | 10/1993 | Kikuo et al. | 345/89 |
| 5,467,009 | A | | 11/1995 | McGlinchey | 323/269 |
| 5,498,932 | A | * | 3/1996 | Shin et al. | 315/169.3 |
| 5,517,212 | A | * | 5/1996 | Inoue | 345/211 |
| 5,532,718 | A | * | 7/1996 | Ishimaru | 345/211 |
| 5,574,475 | A | * | 11/1996 | Callahan, Jr. et al. | 345/100 |
| 5,646,643 | A | * | 7/1997 | Hirai et al. | 345/100 |
| 5,745,092 | A | | 4/1998 | Ito | 345/95 |
| 5,795,069 | A | | 8/1998 | Mattes et al. | 374/183 |
| 5,932,990 | A | | 8/1999 | Kaneko | 320/116 |
| 5,995,072 | A | * | 11/1999 | Nakajima | 345/87 |
| 6,181,313 | B1 | * | 1/2001 | Yokota et al. | 345/100 |
| 6,225,992 | B1 | * | 5/2001 | Hsu et al. | 345/211 |
| 6,275,209 | B1 | * | 8/2001 | Yamamoto | 345/95 |

FOREIGN PATENT DOCUMENTS

| | | |
|---|---|---|
| EP | 0 642 112 | 3/1995 |
| WO | 98/28731 | 7/1998 |

* cited by examiner

*Primary Examiner*—Vijay Shankar
*Assistant Examiner*—Nitin Patel
(74) *Attorney, Agent, or Firm*—Hogan & Hartson, LLP

(57) ABSTRACT

A liquid crystal driving integrated circuit capable of adjusting display contrast and requiring no externally attached components. Transmission gates TG0–TG10 are provided at respective connection points of twelve resistor elements connected in series between a power supply and the ground. One of the voltages V0–V10 derived from the transmission gates TG0–TG10 in accordance with control signals CA0–CA10 is applied to an operational amplifier 8, and used as a reference voltage VLCD0. The control signals CA0–CA10 are obtained by decoding control data D0–D3 supplied from an external source by a decoder 19. Therefore, the reference voltage VLCD0 can be set in a plurality of stages simply by changing control data D0–D3 to a user specified value. As the twelve resistor elements connected in series are formed on the same semiconductor substrate, display contrast can be adjusted without requiring any external components attached to a liquid crystal driving integrated circuit 1.

15 Claims, 8 Drawing Sheets

| CONTROL DATA | | | | CONTROL SIGNALS | | | | | | | | | | | REFERENCE VOLTAGE |
|---|---|---|---|---|---|---|---|---|---|---|---|---|---|---|---|
| D0 | D1 | D2 | D3 | CA0 | CA1 | CA2 | CA3 | CA4 | CA5 | CA6 | CA7 | CA8 | CA9 | CA10 | VLCD0 |
| 0 | 0 | 0 | 0 | H | L | L | L | L | L | L | L | L | L | L | V0 |
| 1 | 0 | 0 | 0 | L | H | L | L | L | L | L | L | L | L | L | V1 |
| 0 | 1 | 0 | 0 | L | L | H | L | L | L | L | L | L | L | L | V2 |
| 1 | 1 | 0 | 0 | L | L | L | H | L | L | L | L | L | L | L | V3 |
| 0 | 0 | 1 | 0 | L | L | L | L | H | L | L | L | L | L | L | V4 |
| 1 | 0 | 1 | 0 | L | L | L | L | L | H | L | L | L | L | L | V5 |
| 0 | 1 | 1 | 0 | L | L | L | L | L | L | H | L | L | L | L | V6 |
| 1 | 1 | 1 | 0 | L | L | L | L | L | L | L | H | L | L | L | V7 |
| 0 | 0 | 0 | 1 | L | L | L | L | L | L | L | L | H | L | L | V8 |
| 1 | 0 | 0 | 1 | L | L | L | L | L | L | L | L | L | H | L | V9 |
| 0 | 1 | 0 | 1 | L | L | L | L | L | L | L | L | L | L | H | V10 |

Fig. 6

INTEGRATED CIRCUIT FOR DRIVING LIQUID CRYSTAL

BACKGROUND OF THE INVENTION

1. Field of the Invention

The present invention relates to an integrated circuit for driving liquid crystal capable of adjusting display contrast.

2. Description of the Related Arts

FIG. 1 is a circuit block diagram illustrating a method of adjusting display contrast using a conventional integrated circuit for driving liquid crystal.

Referring to FIG. 1, a liquid crystal panel 101 includes a plurality of segment electrodes and a plurality of common electrodes arranged in a matrix. A segment driving signal and a common driving signal are applied to the plurality of segment electrodes and the plurality of common electrodes of the liquid crystal panel 101, respectively, and light is turned on only at the intersection of the matrix for which the potential difference between the segment driving signal and the common driving signal exceeds a prescribed value.

A liquid crystal driving integrated circuit 102 drives the liquid crystal panel 101 to present a display. In the liquid crystal driving integrated circuit 102, respective connection points of four serially connected resistor elements R1 forming a resistor are connected to terminals 103–107. The terminal 103 receives a reference voltage VLCD0 setting peak values of the segment and common driving signals, and the terminal 107 connects all components of the circuit 102 in common to ground. The potential difference between the reference voltage VLCD0 and a ground voltage Vss is quartered by the four resistor elements R1. The voltages at the terminals 103–107 will be hereinafter denoted as VLCD0, VLCD1, VLCD2, VLCD3, and Vss, respectively. The common driving circuit 108 receives the voltages VLCD0, VLCD1, VLCD3, and Vss to generate the common driving signal. The common driving signal changes between the reference voltage VLCD0 and the ground voltage Vss to turn on light at the liquid crystal panel 101, and changes between the voltages VLCD1 and VLCD3 to turn off light at the panel 101. Therefore, in this case, the common driving signal assumes a ¼ bias driving waveform. On the other hand, a segment driving circuit 109 receives the voltages VLCD0, VLCD2, and Vss to generate the segment driving signal. When a light is to be turned on at the liquid crystal panel 101, the segment driving signal changes between the reference voltage VLCD0 and the ground voltage Vss in a phase opposite to that of the common driving signal for turning on light. On the other hand, the segment driving signal remains unchanged at the voltage VLCD2 when light is to be turned off at the panel 101. The reference voltage VLCD0 determines display contrast (difference in display between when light is on and off). Therefore, the display contrast of the liquid crystal panel 101 can be optimized by having a variable reference voltage VLCD0 and changing the amplitudes of the common and segment driving signals.

A reference voltage generation circuit 110 applies the reference voltage VLCD0 to the terminal 103. In the circuit 110, a resistor 111 and a variable resistor 112 are connected in series between a power supply voltage Vdd and a ground voltage Vss. An operational amplifier 113 outputs a voltage equal to that present at the connection point between the resistor 111 and the variable resistor 112 as the reference voltage VLCD0. When the impedance of the resistor formed by the four serially connected resistor elements R1 exceeds the load impedance of the liquid crystal panel 101 and the like, the voltages VLCD1–3 are likely to be unsettled. Therefore, the operational amplifier 113 having a small output impedance is used. A resistor may be externally connected between the terminals 103–107 to form a resistor member connected in parallel to the four serially connected resistor elements R1, to thereby reduce the impedance on the side of the serially connected resistor elements R1. The reference voltage generation circuit 110 receives a control signal for changing the value of the variable resistor 112 from an external controller. Thus, the reference voltage VLCD0 is changed under the control of the external controller, to thereby adjust the display contrast of the liquid crystal panel 101.

However, in the circuit arrangement of FIG. 1, the reference voltage generation circuit 110 must be externally connected to the liquid crystal driving integrated circuit 102. Thus, as the circuit 110 includes a great number of elements, it would impede reduction in cost of electronic devices. In addition, ports of the external controller for specific use are dedicated for output of control signals, which would hinder the electronic devices from assuming higher functions.

FIG. 2 is another circuit block diagram illustrating a method of adjusting display contrast using a conventional liquid crystal driving integrated circuit, which attempts to solve the problems of the circuit in FIG. 1. In FIG. 2, the liquid crystal panel 101, the common driving circuit 108, and the segment driving circuit 109 of FIG. 1 are not shown.

In the integrated circuit 201 for driving liquid crystal, the respective connection points of the four serially connected resistor elements R1 are connected to terminals 202–206 for a similar purpose to that described in connection with FIG. 1. The terminal 202 is a power supply terminal receiving the power supply voltage Vdd. A regulator 207 outputs a constant voltage VRF based on the power supply voltage Vdd. An operational amplifier 208 has a positive terminal connected to the constant voltage VRF, a negative terminal connected to a terminal 209, and an output terminal connected to the terminal 206. The value of current IR flowing across the negative terminal of the operational amplifier 208 can be adjusted under the control of an internal controller.

Three serially connected external resistor elements R2, R3, and R4 forming another resistor are connected between the terminals 202 and 206, and an intermediate terminal of the external resistor element R3 is connected to the terminal 209. The serially connected resistor elements R2, R3, and R4 are divided into two parts by the intermediate terminal of the resistor element R3. The resistance of the part consisting of the resistor element R2 and a portion of the resistor element R3 will be denoted as Ra, and that of the part consisting of the remaining portion of the resistor element R3 and the resistor element R4 as Rb.

A voltage VLCD4 can be given by ((Ra+Rb)/Ra)VRF+IR·Rb. Thus, the value of current IR is controlled by the internal controller to change the voltage VLCD4, thereby adjusting the display contrast of the liquid crystal panel 101.

However, while the liquid crystal driving integrated circuit 201 of. FIG. 2 requires only the resistor elements R2, R3, and R4 as external elements, a ratio of the voltages Ra and Rb would deviate from the expected value because of variation in resistance of the resistor elements R2, R3, and R4, making it impossible to achieve appropriate display contrast. Consequently, the variation in resistance of the resistor elements R2–R4 must be corrected under the control of the external controller, resulting in similar problems to those discussed in connection with FIG. 1.

SUMMARY OF THE INVENTION

An object of the present invention is to provide an integrated circuit for driving liquid crystal that requires no external elements and allows adjustment of display contrast.

The present invention has been conceived to solve the above problems. According to a first aspect thereof, the present invention,provides a liquid crystal driving integrated circuit for generating a liquid crystal driving voltage that drives a liquid crystal panel to present a display from respective connection points of a plurality of serially connected resistor elements forming a first resistor. In the liquid crystal driving integrated circuit, a reference voltage applied to one end of the first resistor formed by the plurality of serially connected resistor elements is variable so as to adjust the display contrast of the liquid crystal panel. The above integrated circuit includes a second resistor formed by a plurality of serially connected resistor elements and connected to a power supply, a reference voltage generation circuit having a selection circuit for deriving one of the voltages at respective connection points of the plurality of serially connected resistor elements forming the second resistor, and generating the reference voltage based on an output of the selection circuit, a holding circuit for holding control data applied from an external source to control the selection circuit, and a decoding circuit for decoding the control data held in the holding circuit and generating a control signal to operate the selection circuit.

The above reference voltage generation circuit may include a plurality of gate circuits for deriving one of the voltages at the respective connection points of the plurality of serially connected resistor elements forming the second resistor based on the value of the control signal, and an operational amplifier receiving the voltage derived from the plurality of gate circuits. An output of the operational amplifier is used as the reference voltage.

The above holding circuit may include a shift register for holding control data obtained by serially connecting first and second bit strings, a clock generation circuit for generating a clock signal based on the first bit string, and a latch circuit for latching the second bit string in accordance with the clock signal and supplying the string to the decoding circuit. The control data is applied from an external source, serially connected with address data for determining whether or not the liquid crystal driving integrated circuit receiving the data is to be controlled. The control data can be held in the shift register only when the address data is matched with a predetermined value. A match detection circuit may further be provided between an external input and an input of the shift register to detect a match between the address data and the predetermined value.

According to a second aspect of the present invention, a liquid crystal driving integrated circuit includes a first switch circuit for connecting one end of the first resistor formed by the serially connected resistor elements with a power supply, a second switch circuit for connecting or disconnecting the second resistor formed by the serially connected resistor elements with or from the power supply, and a circuit for enabling or disabling operation of the reference voltage generation circuit. When the reference voltage generation circuit is to be operated, the first switch circuit is turned off and the second switch circuit is turned on. When the reference voltage generation circuit is to be turned off, the first switch circuit is turned on and the second switch circuit is turned off.

BRIEF DESCRIPTION OF THE DRAWINGS

FIG. 6 shows the relationship among control data, control signals, and reference voltages.

DESCRIPTION OF THE PREFERRED EMBODIMENTS

The present invention will be described in detail with reference to the drawings.

[First Embodiment]

Figure 3:
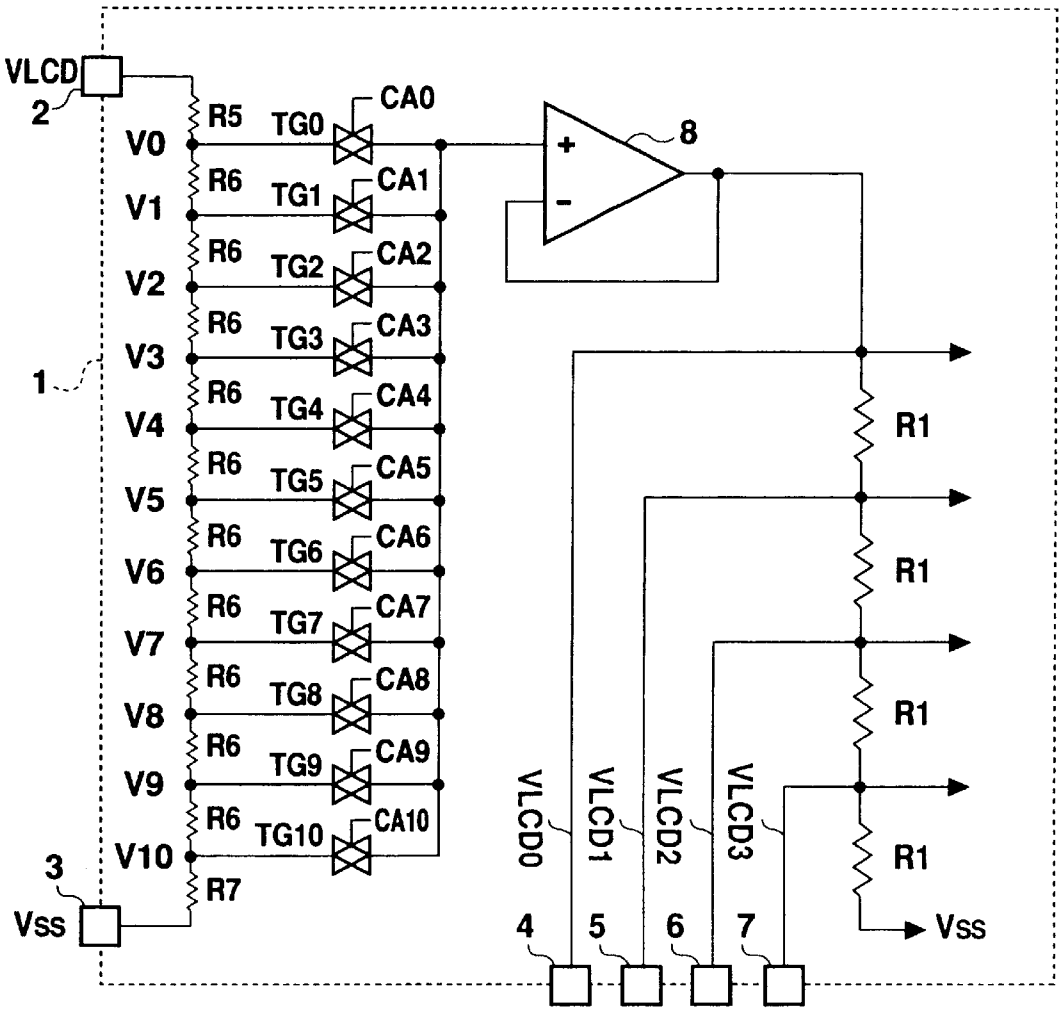
FIG. 3 is a circuit diagram illustrating a main part of a liquid crystal driving integrated circuit according to a first embodiment of the present invention.

FIG. 3 is a circuit diagram showing a main part of a liquid crystal driving integrated circuit according to a first embodiment of the present invention.

Referring to FIG. 3, a liquid crystal driving integrated circuit 1 shown in the broken lines includes a terminal 2 for receiving a power supply voltage VLCD for driving liquid crystal, a terminal 3 for receiving a ground voltage Vss, and terminals 4, 5, 6, and 7 for providing voltages VLCD0, VLCD1, VLCD2, and VLCD3 at respective connection points of four serially connected resistor elements R1 forming a resistor. The lower end of the resistor formed by the four serially connected resistor elements is connected to the terminal 3 for connecting all the internal elements of the circuit 1 in common to ground.

In the integrated circuit 1 for driving liquid crystal, twelve resistor elements, including a resistor element R5, ten resistor elements R6, and a resistor element R7, are connected in series between the power supply terminal 2 and the ground terminal 3. At the connection points of these twelve resistor elements connected in series, eleven voltages V0–V10 are generated divided by respective resistance values. As the twelve resistor elements connected in series are integrated on a single semiconductor substrate, variation in resistance due to manufacturing of the twelve resistor elements will be the same. Thus, the voltages V0–V10 determined by the ratio of resistance values will not be affected by the variation generated during manufacturing, so that a stable reference voltage VLCD0 can be obtained. Each of eleven transmission gates TG0–TG10 has one end connected to a connection point of the twelve serially connected resistor elements, and derives one of the eleven voltages V0–V10 in accordance with control signals CA0–CA10. The control signals CA0–CA10 are binary signals attaining either high level (logic "1") or low level (logic "0"), with only one of the control signals CA0–CA10 attaining a high level.

An operational amplifier 8 has a positive (non-inverting input) terminal connected in common to respective other ends of the transmission gates TG0–TG10, providing as an output the reference voltage VLCD0 for liquid crystal display based on the voltage output from one of the transmission gates TG0–TG10. It should be noted that when the impedance of the resistor formed by the four serially connected resistor elements R1 exceeds the load impedance of the succeeding liquid crystal driving circuit, liquid crystal panel, and the like, the voltages VLCD1, VLCD2, VLCD3 are likely to be unsettled due to decrease in current flowing across the serially connected resistor elements R1. Therefore, taking the magnitude of the load impedance into consideration, an operational amplifier 8 with a low output impedance is used. It is also effective to connect external resistors between the terminals 3–7 to be in parallel to the four serially connected resistor elements R1, to thereby reduce the impedance on the side of the resistor elements R1.

Figure 1:
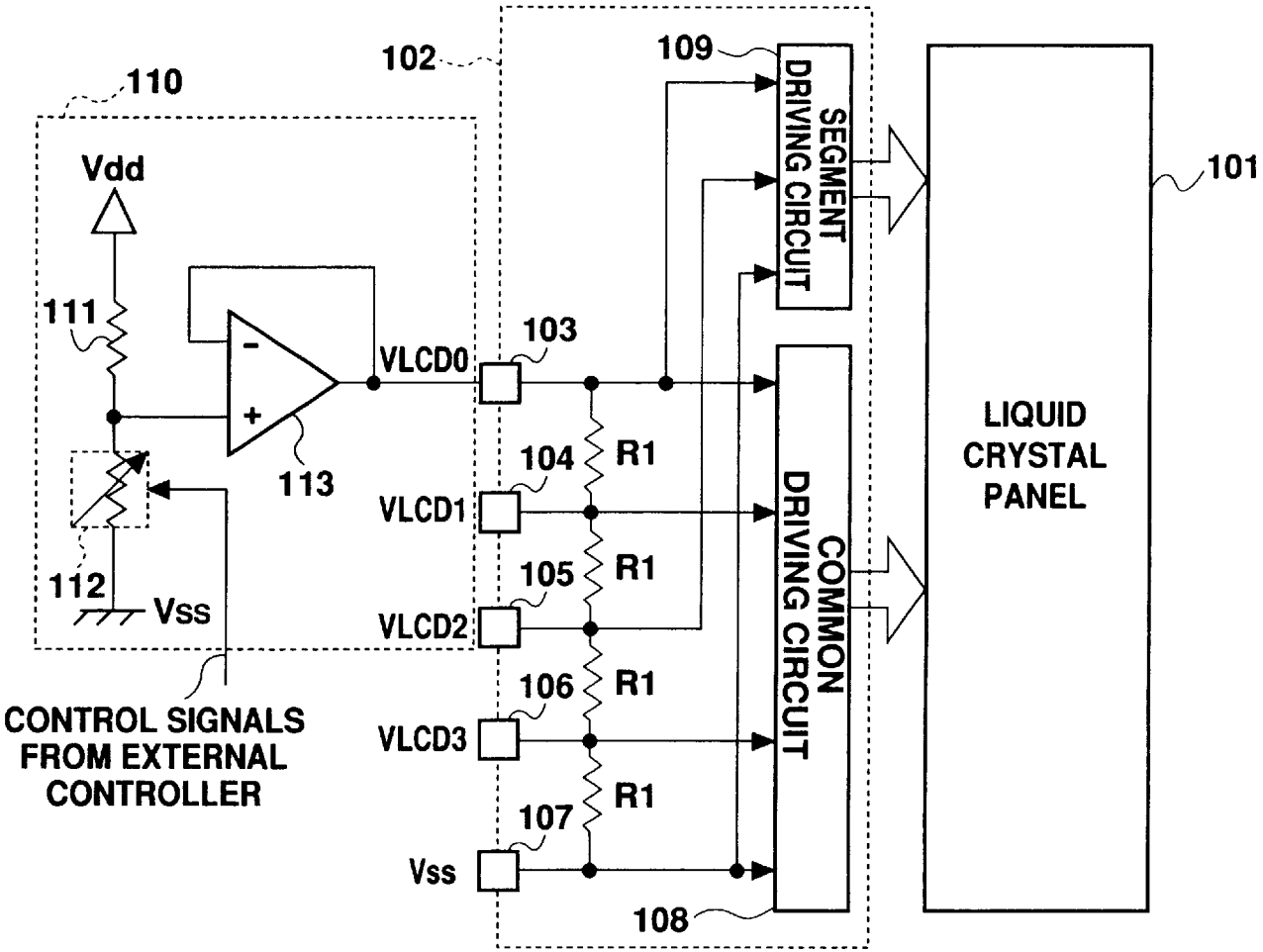
Fig. 1 PRIOR ART
FIG. 1 is a circuit block diagram illustrating a conventional integrated circuit for driving liquid crystal.
Figure 2:
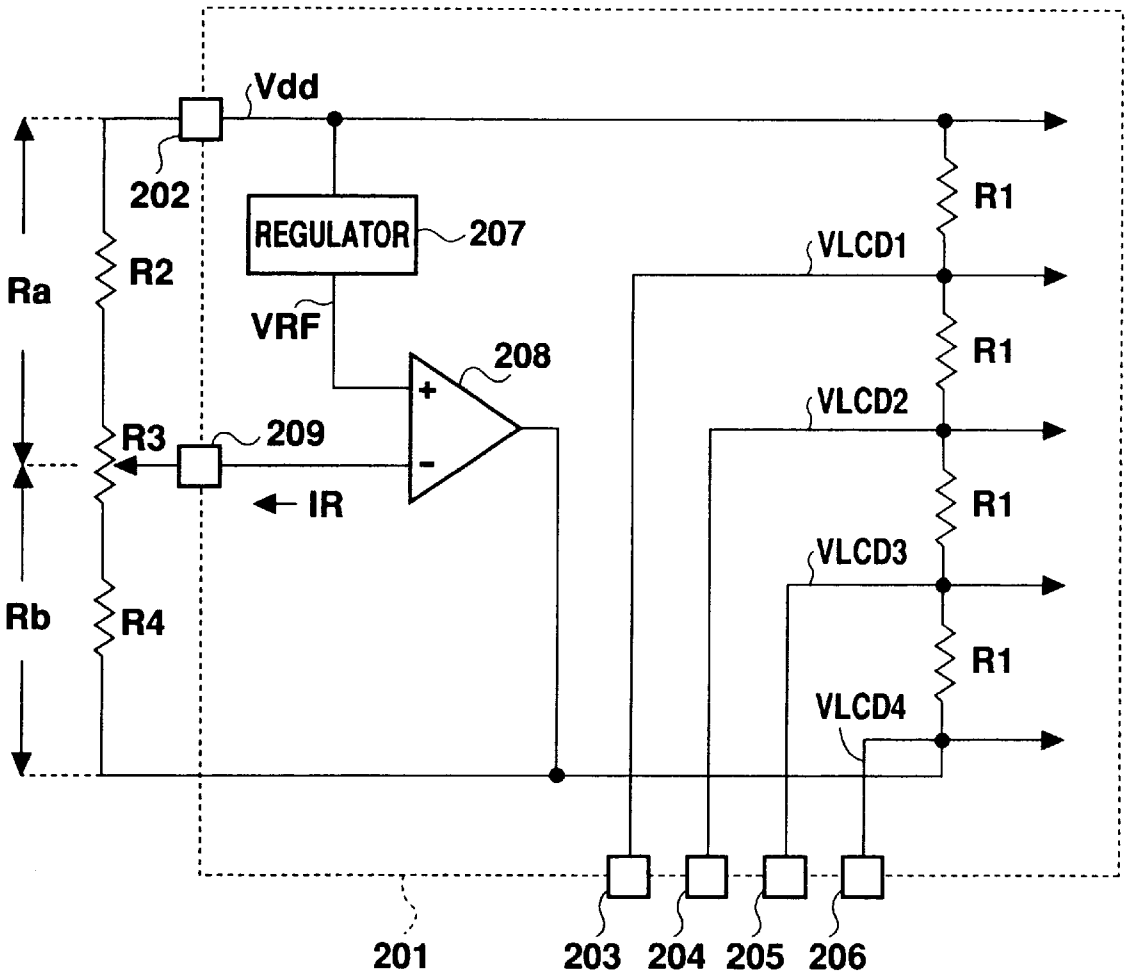
Fig. 2 PRIOR ART
FIG. 2 is another circuit block diagram illustrating a conventional integrated circuit for driving liquid crystal.

The five voltages VLCD0, VLCD1, VLCD2, VLCD3, and Vss obtained at respective connection points of the four serially connected resistor elements R1 are applied to a common driving circuit and a segment driving circuit, as in the circuit of FIG. 1. The liquid crystal panel receives common and segment driving signals to display a character and the like. As the stage succeeding the four serially connected resistor elements R1 is the same as that of the circuit shown in FIG. 1, description thereof with reference to FIG. 3 will not be repeated.

Figure 4:
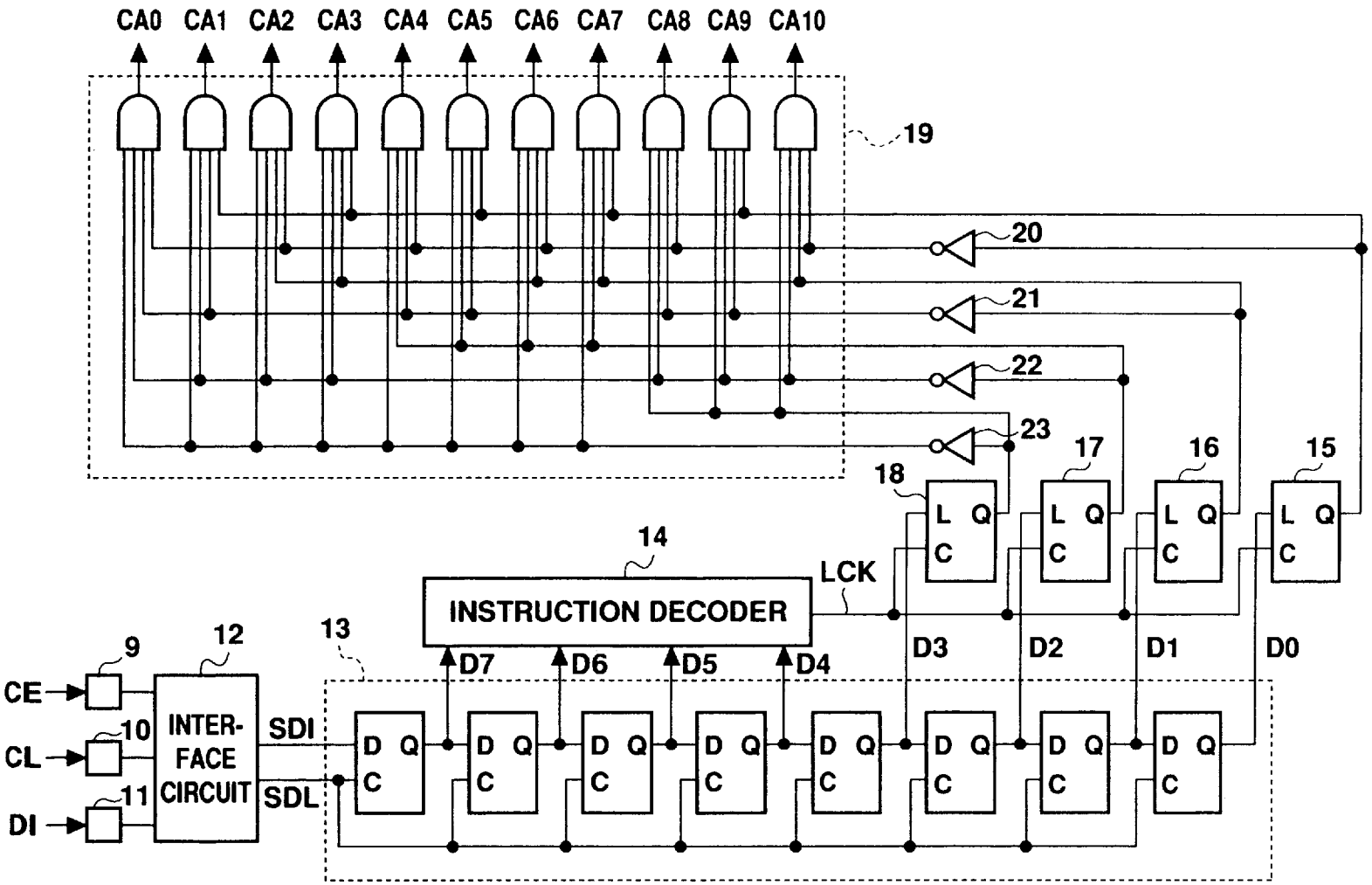
FIG. 4 is a circuit diagram illustrating a portion for outputting control signals in the liquid crystal driving integrated circuit according to the first embodiment of the present invention.

FIG. 4 is a circuit block diagram illustrating part of the liquid crystal driving integrated circuit that generates control signals CA0–CA10. According to the present embodiment, the liquid crystal driving integrated circuit 1 serves as an interface between integrated circuits allowing only particular input data.

Terminals 9, 10, and 11 are external input terminals for setting control signals CA0–CA10, receiving an operation enable signal CE, a clock signal CL, and serial data DI from other integrated circuits such as a microcomputer. More specifically, the serial data DI contains, in a serial manner, unique address data for identifying the liquid crystal driving integrated circuit 1, and control data for setting control signals CA0–CA10. The serial data DI can be output from a serial output port of an external controller such as a microcomputer. An interface circuit 12 detects the status of the operation enable signal CE, the clock signal CL, and the serial data DI, and outputs control data SDI and a clock signal SCL. More specifically, the interface circuit 12 detects a match of the address data when the operation enable signal CE is at the low level, and outputs the control data when the operation enable signal CE changes to the high level.

Figure 5:
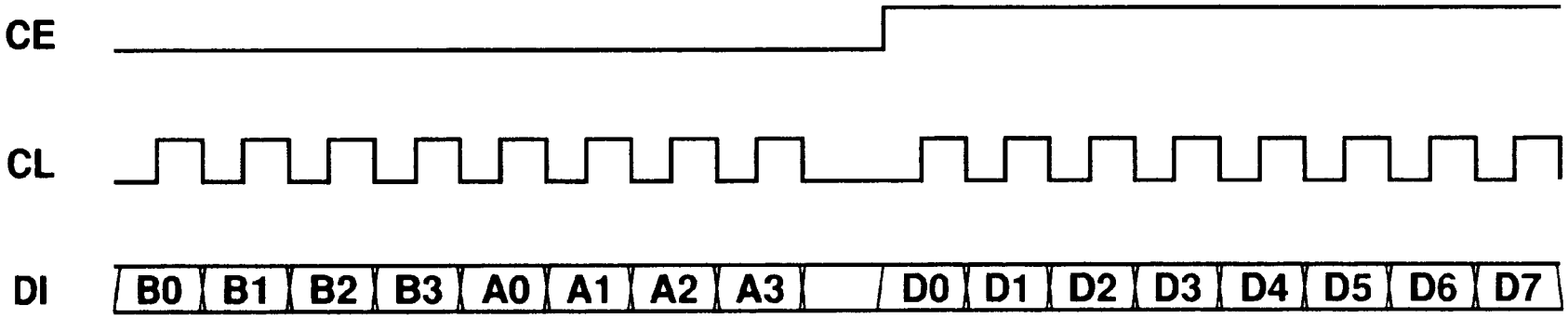
FIG. 5 is a timing chart of externally input signals.

Operation of the interface circuit 12 will be described with reference to the timing chart shown in FIG. 5. When the operation enable signal CE is at the low level, the interface circuit 12 determines whether or not the address data B0–B3 and A0–A3 supplied in synchronization with the clock signal CL are the unique values predetermined for the liquid crystal driving integrated circuit 1. When the address data B0–B3 and A0–A3 match with the values unique to the circuit 1 and the operation enable signal CE changes to the high level, the interface circuit 12 provides the clock signal CL and the control data D0–D7 as the clock signal SCL and the control data SDI, respectively.

A shift register 13 is formed by cascading eight D-type flip flops, successively right shifting 8-bit control data D0–D7 in synchronization with the clock signal SCL.

An instruction decoder 14 outputs a latch clock signal LCK when 4 bits D4–D7 of the control data corresponding to an instruction code are detected as the predetermined values unique to the liquid crystal driving integrated circuit 1.

Latch circuits 15, 16, 17, and 18 latch the remaining 4 bits D0–D3 of the 8-bit control data for setting control signals CA0–CA10 in synchronization with the latch clock signal LCK.

A decoder 19 outputs control signals CA0–CA10, only one of which attains a high level, based on eight signals consisting of output signals from respective Q terminals of the latch circuits 15–18 and the inverted versions of these output signals supplied by inverters 20, 21, 22, and 23. More specifically, the decoder 19 includes eleven AND gates, and the above eight signals are wired in a matrix to these eleven AND gates in the decoder 19 so that only one of the control signals CA0–CA10 output from the AND gates attains a high level. FIG. 6 shows the relationship among the control data D0–D3, control signals CA0–CA10, and the reference voltage VLCD0. When the set of control data D0–D3 is one of those shown in FIG. 6, a corresponding one of the control signals CA0–CA10 attains a high level and the reference voltage VLCD0 is correspondingly set as one of the voltages V0–V10.

As described above, the reference voltage VLCD0 for liquid crystal display can be set in eleven stages (voltages V0–V10) simply by changing the control data D0–D3. Therefore, the display contrast can be adjusted without attaching external components to the liquid crystal driving integrated circuit 1, allowing cost reduction of electronic devices using the circuit 1. In addition, as serial output ports of the external controller can be used for control of the liquid crystal driving integrated circuit 1, there is no need to use specific ports for this purpose. Accordingly, the specific ports of the external controller can be used for other purposes, so that the electronic devices using the liquid crystal driving integrated circuit 1 can be provided with higher functions.

While the circuit is described as including a first resistor formed by four resistor elements R1 and a second resistor formed by twelve resistor elements, i.e. resistor elements R5, R6, and R7, in this embodiment, respective resistors can include other numbers of serially connected resistor elements.

[Second Embodiment]

Some components in the present embodiment are the same as those in the liquid crystal driving integrated circuit of the above-described first embodiment, and therefore, for the sake of convenience, the components identical to those in the first embodiment are labeled with identical numbers. Also, the elements of the liquid crystal driving integrated circuit of the present embodiment that are identical to those of the circuit according to the first embodiment will not be described again. Description here is mainly focused on the difference between the two circuits.

Figure 7:
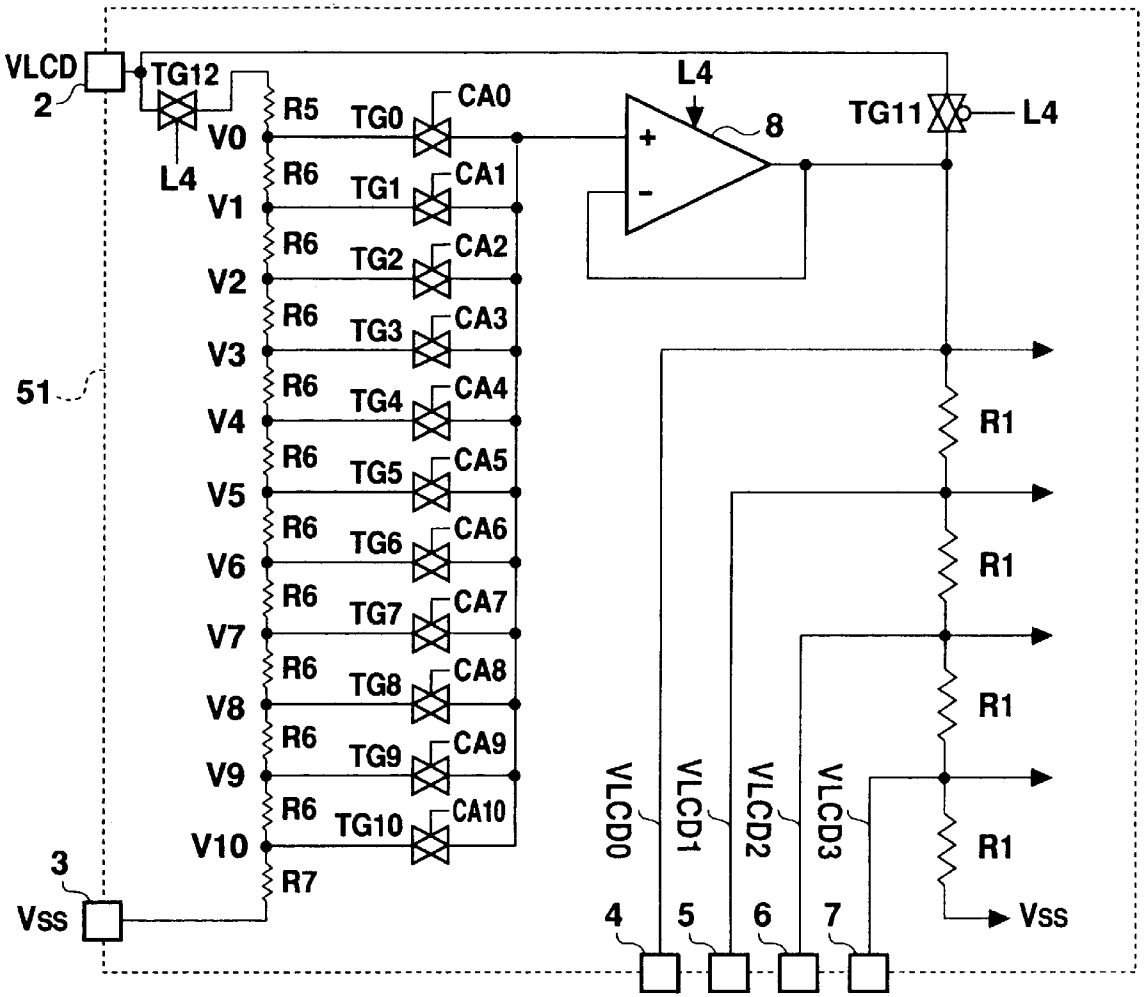
FIG. 7 is a circuit diagram illustrating a main part of a liquid crystal driving integrated circuit according to a second embodiment of the present invention.

FIG. 7 is a circuit diagram illustrating a main part of a liquid crystal driving integrated circuit according to a second embodiment of the present invention.

A liquid crystal driving integrated circuit 51 shown in the broken lines of FIG. 7 comprises, as in the first embodiment, a first resistor formed by four serially connected resistor elements R1, and a second resistor formed by a resistor element R5, ten resistor elements R6, and a resistor element R7 connected in series. The circuit of the present embodiment differs from the liquid crystal driving integrated circuit 1 of the first embodiment in the following respects. First, the present circuit includes a first switch circuit for controlling connection between one end of the first resistor and a power supply. Secondly, the circuit further includes a second switch circuit for controlling connection between the second resistor and the power supply. Thirdly, the present circuit can switch on/off the operational amplifier 8.

A transmission gate TG11 corresponds to the above-described first switch circuit. The transmission gate TG11 is connected between the power supply terminal 2 and the output terminal of the operational amplifier 8, allowing application of the voltage VLCD to one end of the resistor formed by the four serially connected resistor elements R1. A transmission gate TG12 corresponds to the above-described second switch circuit, connected between the power supply terminal 2 and one end of the resistor element R5. The transmission gate TG12 can block application of the power supply voltage VLCD to the twelve serially connected resistor elements including resistor elements R5, R6 and R7. The transmission gates TG11 and TG12 are controlled to operate in a complementary manner by a signal L4 based on the control data D4 as described hereinafter. Operation of the operational amplifier 8 is also controlled by the signal L4. For example, the level of a control electrode for a current source transistor contained in the operational amplifier 8 can be controlled by the signal L4. More specifically, when the signal L4 is at one logic level, the current source transistor is turned on to operate the operational amplifier 8, and when the signal L4 is at the other logic level, the current source transistor is turned off to stop operation of the amplifier 8. While the operational amplifier 8 is in operation, the transmission gate TG11 is in an off state and the gate TG12 is in an on state. On the other hand, while the operational amplifier 8 is not operating, the transmission gate TG11 is in an on state and the gate TG12 is in an off state.

Figure 8:
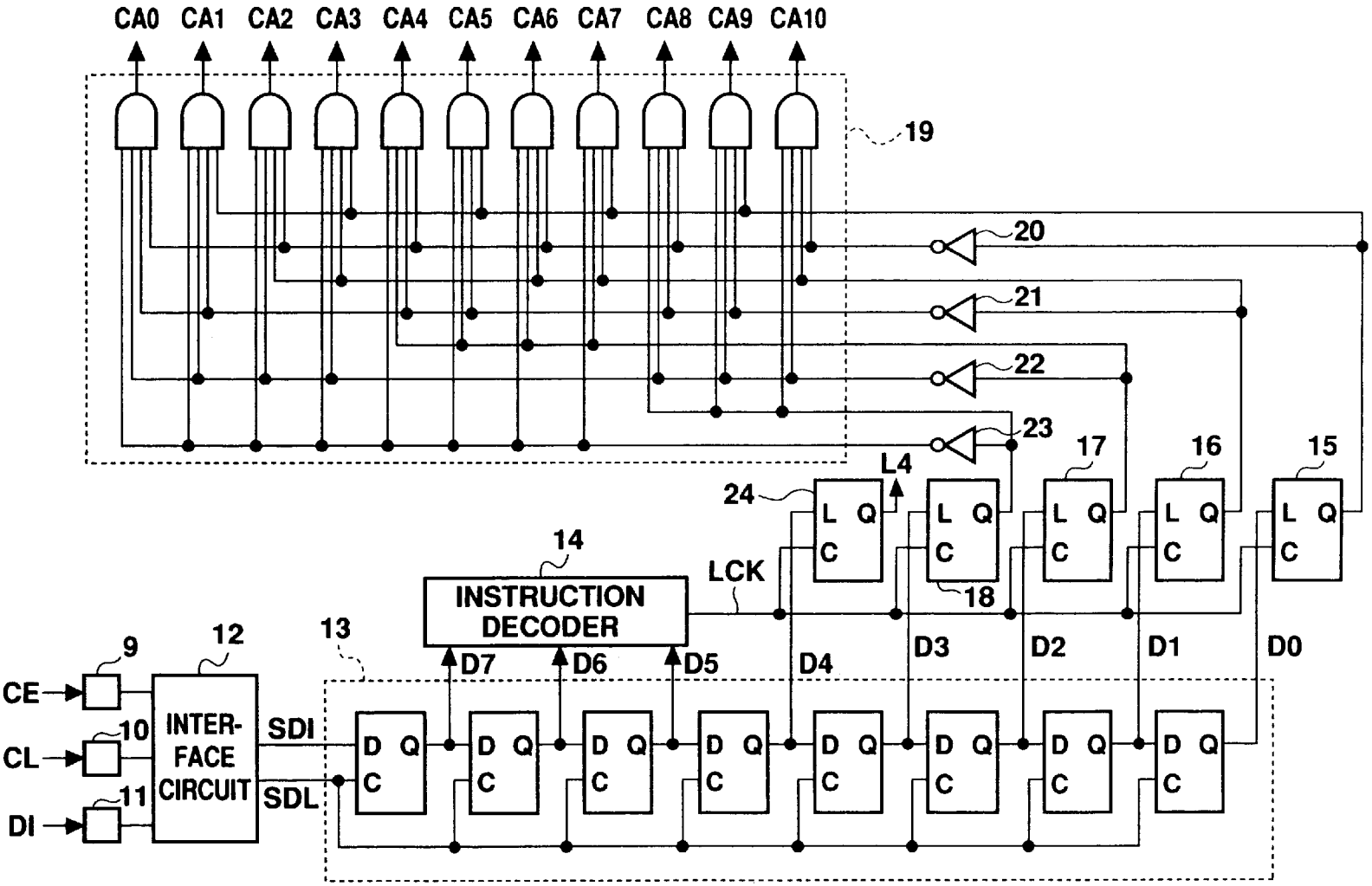
FIG. 8 is a circuit diagram illustrating a portion for outputting control signals in the liquid crystal driving integrated circuit according to the second embodiment of the present invention.

FIG. 8 is a circuit block diagram illustrating part of the liquid crystal driving integrated circuit that generates control signals CA0–CA10. The liquid crystal driving integrated circuit 51 serves as an interface between integrated circuits allowing only particular input data, as does the circuit 1.

The shift register 13 successively right shifts 8-bit control data D0–D7 output from the interface circuit 12 in synchronization with the clock signal SCL.

The instruction decoder 14 outputs the latch clock signal LCK when 3 bits D5–D7 of the control data corresponding to an instruction code are detected as the unique values predetermined for the liquid crystal driving integrated circuit 51. According to the present embodiment, the control data D4 is used for generation of the signal L4 as described below.

The latch circuits 15, 16, 17, and 18 latch the remaining four bits D0–D3 of the control data for setting the control signals CA0–CA10 in synchronization with the latch clock signal LCK. Similarly, a latch circuit 24 latches a bit D4 of control data in synchronization with the latch clock signal LCK. The signal L4 output from a Q terminal of the latch circuit 24 is supplied to the transmission gates TG11 and TG12 and the operational amplifier 8. More specifically, when the control data D4 is logic "0", the transmission gate TG11 is turned on, the transmission gate TG12 is turned off, and the operational amplifier 8 stops operation. As a result, the liquid crystal driving voltages VLCD0–VLCD3 are determined based on the power supply voltage VLCD, so that the display contrast of the liquid crystal panel is in a fixed state, uncontrollable by the external controller, or is adjustable by an external resistor. On the other hand, when the control data D4 is logic "1", the transmission gate TG11 is turned off, the transmission gate TG12 is turned on, and the operational amplifier is operated. Consequently, the liquid crystal driving voltages VLCD0–VLCD3 can be varied in accordance with the control signals CA0–CA10, and the display contrast of the liquid crystal panel can be adjusted by the external controller. It should be noted that the control signals CA0–CA10 are generated by the decoder 19 based on the relationship shown in FIG. 6.

As described above, the liquid crystal driving integrated circuit 51 of the present embodiment provides an advantage that, when a user determines that the established intervals between the reference voltages V0–V10 for adjusting display contrast are not appropriate, the display contrast can be adjusted by an external resistor, providing the user with a wider option of voltages for adjusting the display contrast, in addition to the advantages of achieving cost reduction and higher functions of the electronic devices using the liquid crystal driving integrated circuit described in connection with the first embodiment.

As in the first embodiment, the above-described two resistors can also be formed by a different number of resistor elements than that described above.

As described above, according to the present invention, the reference voltage for liquid crystal display can be set in a plurality of stages simply by changing the control data to a user specified value. Therefore, the display contrast can be adjusted without attaching external devices to the liquid crystal driving integrated circuit, to thereby achieve cost reduction of electronic devices using the liquid crystal driving integrated circuit. In addition, as serial output ports of the external controller are used, the specific ports will not be occupied, so that the specific ports of the external controller can be used for other purposes and the electronic devices using the liquid crystal driving integrated circuit can be provided with higher functions. Further, when a user determines that the established intervals between the reference voltages for adjusting the display contrast obtained from the plurality of second serially connected resistor elements are not appropriate, the display contrast can also be adjusted by an external resistor, advantageously providing a wider option of reference voltages for adjusting the display contrast and allowing the use for more generic purposes.

What is claimed is:

1. A liquid crystal driving integrated circuit (1) for generating a liquid crystal driving voltage that drives a liquid crystal panel to present a display from respective connection points of a plurality of serially connected resistor elements forming a first resistor, wherein a reference voltage applied to one end of said first resistor is variable so as to adjust display contrast of said liquid crystal panel, said circuit comprising:

a second resistor formed by a plurality of serially connected resistor elements and connected to a power supply;

a reference voltage generation circuit having a selection circuit for deriving one of voltages at respective connection points of said plurality of resistor elements forming said second resistor, and generating said reference voltage based on an output from said selection circuit;

a holding circuit for holding control data provided from an external source to control said selection circuit, said holding circuit includes a shift register (13) for holding control data formed by serially connecting first and second bit strings, a clock generation circuit (14) for generating a clock signal based on said first bit string, and a latch circuit (15–18) for latching said second bit string in accordance with said clock signal and supplying said bit string to said decoding circuit; and a decoding circuit (19) for decoding the control data held in said holding circuit and generating a control signal for operating said selection circuit.

2. The liquid crystal driving integrated circuit according to claim 1, wherein said reference voltage generation circuit includes a plurality of gate circuits (TG0–TG10) for deriving one of the voltages at the respective connection points of said plurality of serially connected resistor elements forming said second resistor based on a value of said control signal, and an operational amplifier (8) receiving the voltage derived from said plurality of gate circuits, an output of said operational amplifier being used as said reference voltage.

3. The liquid crystal driving integrated circuit according to claim 1, wherein said control data is externally applied, serially connected with address data for determining whether or not the liquid crystal driving integrated circuit receiving said data is to be controlled, said control data being held in said shift register only when said address data matches with a predetermined value.

4. The liquid crystal driving integrated circuit according to claim 3, further comprising a match detection circuit (12) for detecting a match between said address data and the predetermined value, provided between an external input and an input of said shift register.

5. A liquid crystal driving integrated circuit for generating a liquid crystal driving voltage that drives a liquid crystal panel to present a display from respective connection points of a plurality of serially connected resistor elements forming a first resistor, wherein a reference voltage applied to one end of said first resistor is variable so as to adjust display contrast of said liquid crystal panel, said circuit comprising:

a second resistor formed by a plurality of serially connected resistor elements and connected to a power supply;

a reference voltage generation circuit having a selection circuit for deriving one of voltages at respective connection points of said plurality of serially connected resistor elements forming said second resistor, and generating said reference voltage based on an output of said selection circuit;

a first switch circuit (TG11) for selectively connecting said one end of said first resistor with the power supply or said reference voltage generation circuit;

a second switch circuit (TG12) for connecting or disconnecting said second resistor with or from the power supply; and a circuit for enabling or disabling operation of said reference voltage generation circuit; wherein said first switch circuit is turned off and said second switch circuit is turned on when said reference voltage generation circuit is to be operated, and said first switch circuit is turned on and said second switch circuit is turned off when said reference voltage generation circuit is to be turned off.

6. A liquid crystal driving integrated circuit including a first resistor formed by a plurality of serially connected resistor elements, and generating a liquid crystal driving voltage for driving a liquid crystal panel to present a display from at least one of connection points of the serially connected resistor elements forming said first resistor, wherein a reference voltage applied to one end of said first resistor is changed to adjust display contrast of said liquid crystal panel, said circuit comprising:

a second resistor formed by a plurality of serially connected resistor elements and having one end connected to a power supply;

a reference voltage generation circuit for selecting a voltage at one of ends of the plurality of serially connected resistor elements forming said second resistor, wherein said reference voltage generation circuit including a selection circuit for selecting a voltage at one of the ends of said plurality of serially connected resistor elements forming said second resistor, and generating said reference voltage based on the selected voltage; and a control circuit for controlling the selection of the voltage by said reference voltage generation circuit based on control data applied from an external source, said control circuit including:

a data holding circuit for holding control data, said control data including an instruction code and a selection code, applied from an external source to control said selection circuit, said data holding circuit including a shift register (13) for holding a bit string representing said control data; and a selection code extracting circuit for extracting said selection code from said shift register based on said instruction code and supplying the extracted code to said decoding circuit; and a decoding circuit (19) for decoding said control data held in said data holding circuit and generating a control signal to operate said selection circuit.

7. The liquid crystal driving integrated circuit according to claim 6, wherein said selection code extracting circuit includes:

a latch signal generation circuit (14) for generating a latch clock signal based on said instruction code held in said shift register; and a latch circuit (15–18) for latching said selection code from said shift register based on said latch clock signal and providing said code to said decoding circuit.

8. The liquid crystal driving integrated circuit according to claim 6, wherein address data for determining whether or not a liquid crystal driving integrated circuit receiving said data is to be controlled is serially added to said control data, said integrated circuit further comprising an address judgment circuit (12) for detecting a match between said address data and a value predetermined for the liquid crystal driving integrated circuit receiving said address data, and providing said control data to said shift register.

9. The liquid crystal driving integrated circuit according to claim 6, wherein said reference voltage generation circuit selects one of the voltages at respective connection points of said plurality of serially connected resistor elements forming said second resistor, and generates said reference voltage based on the selected voltage.

10. The liquid crystal driving integrated circuit according to claim 9, said reference voltage generation circuit including:

a plurality of gate circuits connected to the respective connection points of said plurality of serially connected resistor elements forming said second resistor, one of said plurality of gate circuits being rendered conductive in response to a control signal from said control circuit; and an operational amplifier (8) receiving the voltage at said connection point applied from said one of said plurality of gate circuits; wherein an output of said operational amplifier is used as said reference voltage.

11. The liquid crystal driving integrated circuit according to claim 10, wherein said control circuit includes:

a data holding circuit for holding control data applied from an external source to control respective conductive states of said plurality of gate circuits; and a decoding circuit (19) for decoding the control data held in said data holding circuit and generating said control signal.

12. The liquid crystal driving integrated circuit according to claim 6, further comprising:

a first switch circuit (TG11) provided between said one end of said first resistor and said power supply; and a mode switching circuit (24) for generating a mode switching signal to control switching of said first switch circuit and a voltage output from said reference voltage generation circuit; wherein either one of a voltage of said power supply and the voltage output from said reference voltage generation circuit can be selectively applied to said one end of said first resistor as said reference voltage based on said mode switching signal.

13. The liquid crystal driving integrated circuit according to claim 12, further comprising a second switch circuit (TG12) provided between said one end of said second resistor and said power supply, and having its switching operation controlled by said mode switching signal, wherein when said first switch circuit is turned on by said mode switching signal, said second switch circuit and said reference voltage generation circuit are turned off by said mode switching signal; and when said first switch circuit is turned off by said mode switching signal, said second switch circuit and said reference voltage generation circuit are turned on by said mode switching signal.

14. The liquid crystal driving integrated circuit according to claim 12, wherein said reference voltage generation circuit includes a selection circuit for selecting and outputting one of the voltages at the respective connection points of said plurality of serially connected resistor elements forming said second resistor, said control circuit including:

a data holding circuit for holding control data applied from an external source to control said selection circuit; and a decoding circuit (19) for decoding the control data held in said data holding circuit and generating a control signal to operate said selection circuit.

15. The liquid crystal driving integrated circuit according to claim 14, wherein said control data includes a mode designation code, and said mode switching circuit generates said mode switching signal based on said mode designation code.

* * * * *